US009227310B2

(12) United States Patent
Wieland

(10) Patent No.: US 9,227,310 B2
(45) Date of Patent: Jan. 5, 2016

(54) HAND TOOL FOR REMOVING A FLY-SCREEN FROM A WINDOW FRAME

(76) Inventor: Herman Wieland, NSW (AU)

( * ) Notice: Subject to any disclaimer, the term of this patent is extended or adjusted under 35 U.S.C. 154(b) by 853 days.

(21) Appl. No.: 13/370,353

(22) Filed: Feb. 10, 2012

(65) Prior Publication Data

US 2012/0204394 A1 Aug. 16, 2012

(51) Int. Cl.
*B25B 27/14* (2006.01)
*B25B 27/00* (2006.01)

(52) U.S. Cl.
CPC ..... *B25B 27/0092* (2013.01); *B25B 27/14* (2013.01); *Y10T 29/53943* (2015.01)

(58) Field of Classification Search
USPC ..... 29/278
See application file for complete search history.

(56) References Cited

U.S. PATENT DOCUMENTS 3,587,121 A * 6/1971 Morrow ..... 7/166
3,751,785 A 8/1973 Whitesell
4,240,192 A * 12/1980 Davis ..... 29/426.6
4,335,509 A * 6/1982 Smith ..... 30/48
4,648,165 A * 3/1987 Whitehorne ..... 29/225
D314,497 S * 2/1991 Symiczek et al. ..... D8/14
5,575,052 A * 11/1996 Thoresen ..... 29/426.6
6,494,512 B1 * 12/2002 Cada et al. ..... 294/3.6
RE38,093 E * 4/2003 Chiou ..... 30/169
6,994,322 B1 * 2/2006 Wittman ..... 254/131
D539,630 S * 4/2007 Imoto ..... D8/107
D543,808 S * 6/2007 Hallman ..... D8/14
D567,052 S * 4/2008 Vandenberghe ..... D8/89
7,367,098 B2 * 5/2008 Wang ..... 29/235
7,523,525 B2 * 4/2009 Lawless ..... 16/430
D627,617 S * 11/2010 Chambers ..... D8/89
8,032,991 B2 * 10/2011 Lawless ..... 16/430
8,365,378 B1 * 2/2013 Lenart ..... 29/253
2008/0035900 A1 2/2008 Flores
2008/0217592 A1 * 9/2008 Chambers ..... 254/25
2009/0294546 A1 * 12/2009 Bedford ..... 238/351
2010/0199478 A1 8/2010 Balliet

* cited by examiner

*Primary Examiner* — Lee D Wilson
*Assistant Examiner* — Alvin Grant
(74) *Attorney, Agent, or Firm* — Benjamin A. Adler

(57) ABSTRACT

The present disclosure relates to a hand tool for removing a fly-screen from a window frame. The hand tool has a longitudinal axis and comprises a handle portion and a blade portion extending from one end of the handle portion. The blade portion defines at an end distal to the one end of the handle portion, a hook portion for insertion between the fly-screen and the window frame to enable the fly-screen to be removed from the window frame in use.

20 Claims, 3 Drawing Sheets

HAND TOOL FOR REMOVING A FLY-SCREEN FROM A WINDOW FRAME

CROSS-REFERENCE TO RELATED APPLICATIONS

This nonprovisional application claims benefit of priority of provisional application Australian Serial No. 2011900448, filed Feb. 11, 2011, now abandoned, the entirety of which is hereby incorporated by reference.

BACKGROUND OF THE INVENTION

1. Field of the Invention

The present invention relates to hand tools and in particular to a hand tool for removing fly-screens from window frames. The invention has been developed primarily for use in the maintenance or repair of buildings and will be described hereinafter with reference to this application. However, it will be appreciated that the invention is not limited to this particular field of use.

2. Description of the Related Art

Fly-screens are oftentimes difficult to remove from window frames for a number of reasons. For example, undesirable movement or subsidence in a building structure can cause the corresponding window frames to become distorted. Alternatively, a general buildup of contaminants overtime can cause the fly-screens to stick to the window frames. Even adverse weather conditions may cause the window frames to contract. In these situations, people oftentimes resort to a variety of inappropriate tools to try to remove the fly-screen from the window frame, including such tools as screw drivers or knives. Such tools can damage the fly-screen, window frame or both during the removal process. In addition, using such sharp tools is also dangerous to the user, particularly in situations where the fly-screen is strongly held within the window frame or if the conditions are wet or icy.

Therefore, there is a recognized need in the art for improved hand tools for removing a fly-screen from a window frame which will overcome or substantially ameliorate at least some of the deficiencies of the prior art, or to at least provide an alternative. The present invention fulfills this long-standing need and desire in the art.

SUMMARY OF THE INVENTION

According to a first aspect of the present invention, there is provided a hand tool for removing a fly-screen from a window frame. The hand tool has a longitudinal axis and comprises a handle portion; and a blade portion extending from one end of the handle portion, the blade portion defining at an end distal to the one end of the handle portion, a hook portion for insertion between the fly-screen and the window frame to enable the fly-screen to be removed from the window frame in use.

Advantageously, the hook portion of the hand tool can be inserted between any edge of the fly-screen and the window frame.

Preferably, the blade portion is integral with the handle portion.

Advantageously, the hand tool is a one-piece tool for ease of manufacture.

Preferably, the one end of the handle portion has a slot adapted to receive a portion of the blade portion therein.

Advantageously, the portion of the blade portion is firmly held within the slot of the handle portion.

Preferably, the slot comprises a first connection and the portion of the blade portion comprises a complementary second connection, such that in use, the first connection engages the second connection to releasably lock the portion of the blade portion within the slot.

Advantageously, the portion of the blade portion can be releasably locked within the slot of the handle portion.

Advantageously, the blade portion can be replaced with a larger or smaller blade portion as required.

Advantageously, the blade portion can be replaced if it becomes damaged.

Preferably, the one end of the handle portion and the portion of the blade portion each comprise at least one aperture substantially therethrough, such that when substantially aligned in use, the substantially aligned apertures are configured for receiving a corresponding fastener substantially therethrough to releasably lock the portion of the blade portion within the slot.

Advantageously, the blade portion can be replaced with a larger or smaller blade portion as required.

Advantageously, the blade portion can be replaced if it becomes damaged.

Advantageously, the portion of the blade portion can be locked within the slot of the handle portion using one or more fasteners.

Preferably, the one or more fasteners include any one of the following types of fastener: a pin, a screw, a bolt, or a rivet.

Preferably, the blade portion is generally planar and oriented in a plane substantially parallel to the longitudinal axis of the hand tool.

Advantageously, the hook portion has a length in the plane defined by the generally planar blade portion that enables the hook portion to engage a corresponding length of the edge of the fly-screen in use thereby providing more leverage for removing the fly-screen from the window frame.

Advantageously, the hook portion has a length in the plane defined by the generally planar blade portion that enables the hook portion to engage a corresponding length of the edge of the fly-screen in use thereby reducing the risk of damaging the fly-screen when removing it from the window frame.

Preferably, the hook portion has a generally curved side profile.

Advantageously, the generally curved side profile enables the user to insert the hook portion between the edge of the fly-screen and the window frame in use and to rotate the hook portion around the edge of the fly-screen.

Preferably, the generally curved side profile of the hook portion has a depth of about 2 mm to about 30 mm.

Preferably, the generally curved side profile of the hook portion has a depth of about 5 mm to about 20 mm.

Preferably, the generally curved side profile of the hook portion has a depth of about 10 mm to about 15 mm.

Advantageously, the blade portion can be selected according to the dimensions of the edge of the fly-screen such that in use, the generally curved hook portion of the selected blade portion receives the edge of the flyscreen therein enabling the fly-screen to be easily removed from the window frame without damaging either the fly-screen or the window frame.

Preferably, the generally curved side profile of the hook portion has a width of about 2 mm to about 30 mm.

Preferably, the generally curved side profile of the hook portion has a width of about 5 mm to about 20 mm.

Preferably, the generally curved side profile of the hook portion has a width of about 10 mm to about 15 mm.

Advantageously, the blade portion can be selected according to the dimensions of the edge of the fly-screen such that in use, the generally curved hook portion of the selected blade portion receives the edge of the flyscreen therein enabling the fly-screen to be easily removed from the window frame without damaging either the fly-screen or the window frame.

Preferably, the generally curved side profile of the hook portion has a radius of about 1 mm to about 15 mm.

Preferably, the generally curved side profile of the hook portion has a radius of about 2.5 mm to about 10 mm.

Preferably, the generally curved side profile of the hook portion has a radius of about 5 mm to about 7.5 mm.

Advantageously, the blade portion can be selected according to the dimensions of the edge of the fly-screen such that in use, the generally curved hook portion of the selected blade portion receives the edge of the flyscreen therein enabling the fly-screen to be easily removed from the window frame without damaging either the fly-screen or the window frame.

Preferably, the hook portion has a substantially wedge-shaped edge for insertion between the fly-screen and the window frame.

Advantageously, the wedge-shaped edge of the hook portion aids in easy insertion of the hook portion between the edge of the fly-screen and the window frame.

Preferably, the substantially wedge-shaped edge of the hook portion extends beyond the plane of the substantially planar blade portion.

Advantageously, the substantially wedge-shaped edge extending beyond the plane of the generally planar blade portion aids easy removal of the fly-screen from the window frame in use.

Preferably, the handle portion comprises one or more indentations for receiving one or more respective fingers of a hand therein in use.

Advantageously, the one or more indentations for receiving one or more respective fingers of the hand therein in use make the handle portion ergonomic.

Preferably, the one or more indentations are two indentations.

Preferably, the two indentations are two opposing indentations.

Advantageously, the two opposing indentations enable the user to hold the hand tool between the thumb and index finger.

Advantageously, the two opposing indentations define a lip at a second end of the handle portion which provides the user with added grip and something to pull against when removing a fly-screen from a window frame to prevent the hand tool from slipping out of the user's hand in use.

Preferably, the blade portion is manufactured from a substantially rigid material.

Advantageously, the blade portion being manufactured from a substantially rigid material ensures that the blade portion and hook portion do not bend or break in use.

Preferably, the handle portion is manufactured from a substantially rigid material.

Advantageously, the handle portion being manufactured from a substantially rigid material ensures that the handle portion does not bend or break in use.

Other and further aspects, features, and advantages of the present invention will be apparent from the following description of the presently preferred embodiments of the invention given for the purpose of disclosure.

BRIEF DESCRIPTION OF THE DRAWINGS

Notwithstanding any other forms which may fall within the scope of the present invention, a preferred embodiment of the invention will now be described, by way of example only, with reference to the accompanying drawings.

DETAILED DESCRIPTION OF SPECIFIC EMBODIMENTS

Figure 1:
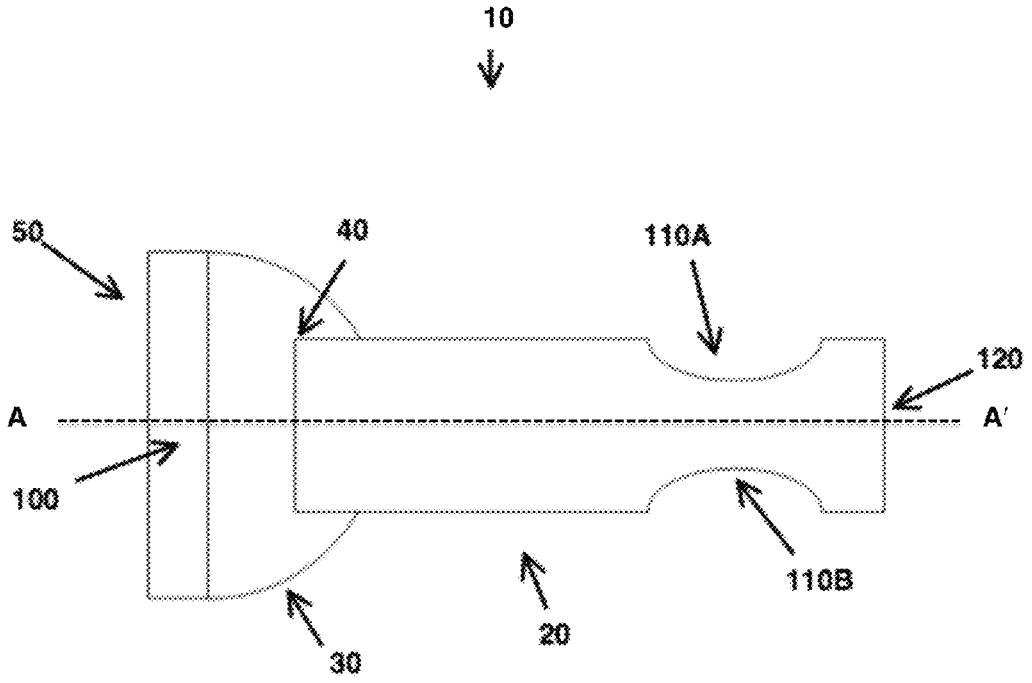
FIG. 1 is a top view of a hand tool for removing a fly-screen from a window frame in accordance with a preferred embodiment of the present invention.

In the description provided herein, numerous specific details are set forth. However, it is understood that embodiments of the invention may be practiced without these specific details. In other instances, well-known methods, structures and techniques have not been shown in detail in order not to obscure an understanding of this description.

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

As used herein, in the claims and description of the invention which follow, except where the context requires otherwise due to express language or necessary implication, the word "comprise" or variations such as "comprises" or "comprising" are used in an inclusive sense, i.e. to specify the presence of the stated features but not to preclude the presence or addition of further features in various embodiments of the invention.

As used herein, any one of the terms "including" or "which includes" or "that includes" is also an open term that also means including at least the elements/features that follow the term, but not excluding others. Thus, including is synonymous with and means comprising.

It should be noted in the following description that like or the same reference numerals in different embodiments denote the same or similar features.

Figure 2:
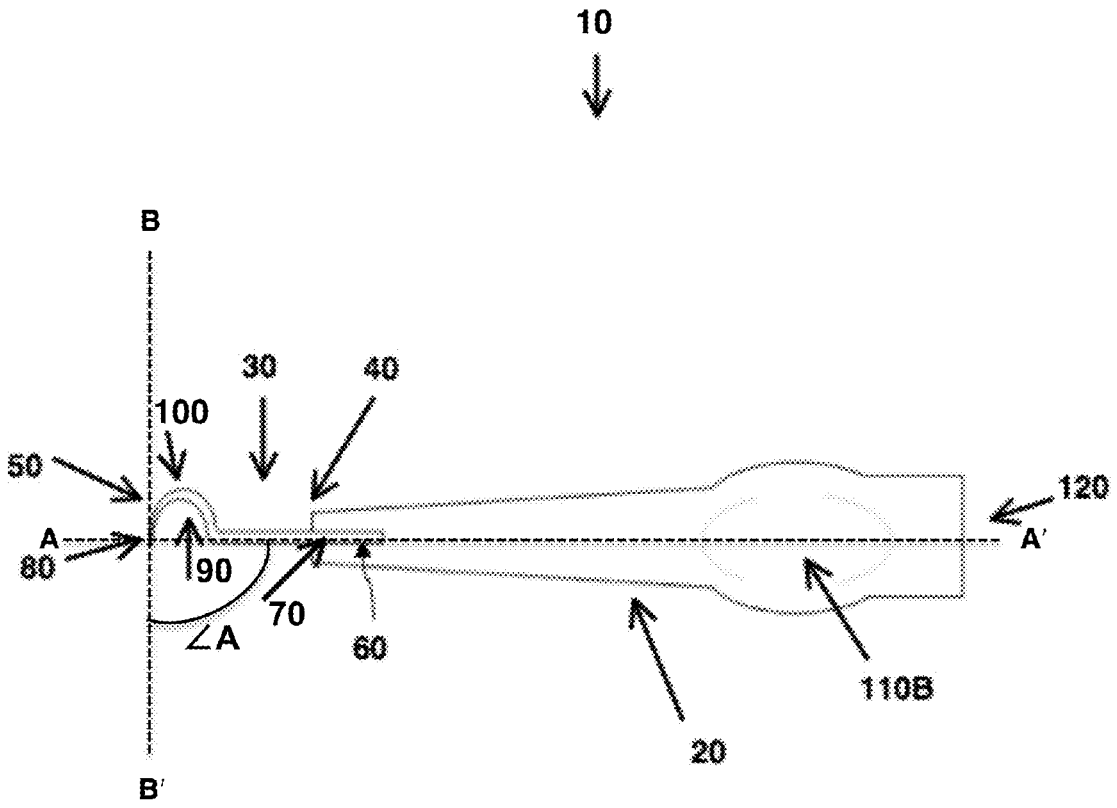
FIG. 2 is a side view of the hand tool of FIG. 1.
Figure 3:
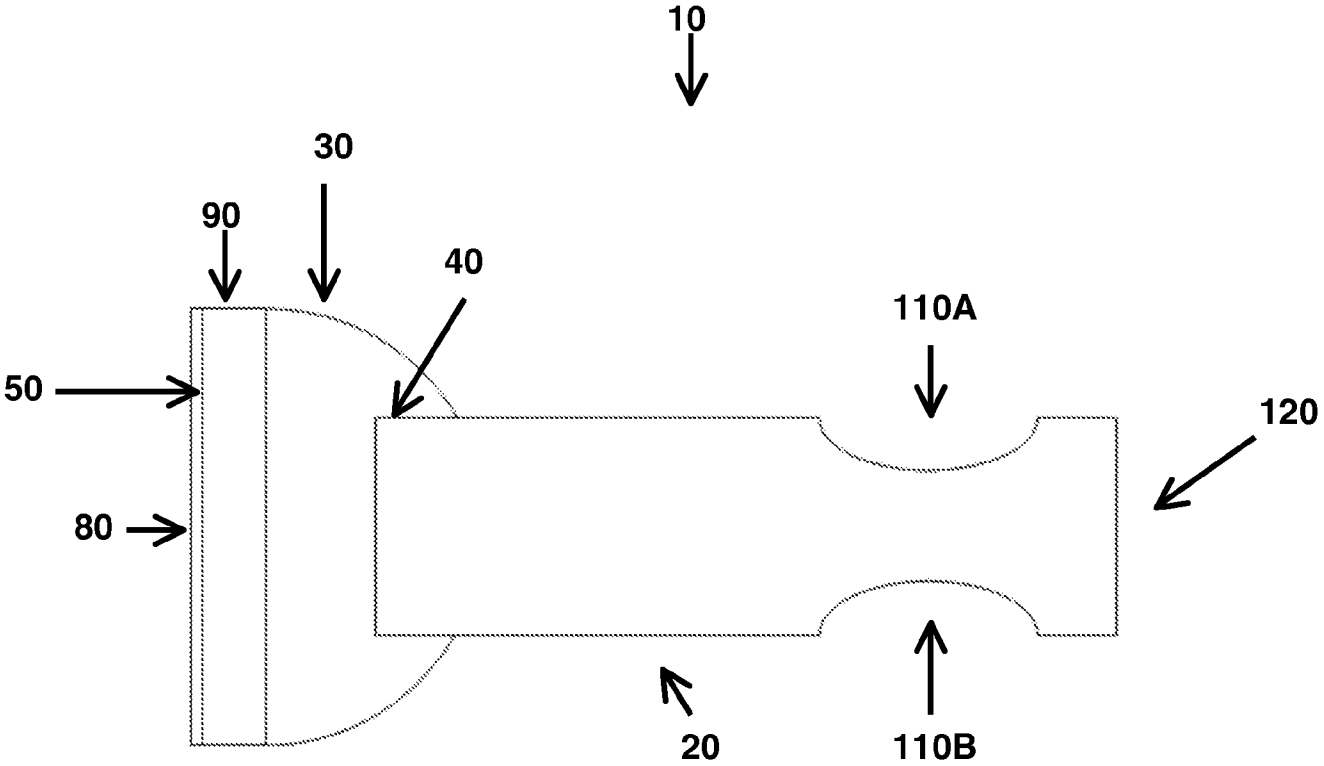
FIG. 3 is a bottom view of the hand tool of FIGS. 1 and 2.

According to a first embodiment of the present invention, and as shown in FIGS. 1 to 3, there is provided a hand tool 10 for removing a fly-screen (not shown) from a window frame (not shown). The hand tool 10 has a longitudinal axis A-A' and comprises a handle portion 20 and a blade portion 30 extending from one end 40 of the handle portion 20. The handle portion 20 is a generally elongate handle portion 20 having a longitudinal axis that corresponds with the longitudinal axis of the hand tool 10.

As shown in FIGS. 1 and 3, the blade portion 30 is a generally planar blade portion 30 and oriented in a plane substantially parallel to the longitudinal axis of the hand tool 10. The handle portion 20 and blade portion 30 of the hand tool 10 are manufactured from a substantially rigid material, which may include any one of the following substantially rigid materials: a plastic, a metal, a wood, a composite, a ceramic, or a combination thereof. In this embodiment, the substantially rigid material is ideally a substantially rigid plastic material such as poly vinyl chloride (PVC), high density polyethylene (HDPE) or polycarbonate (PC). Such plastics are robust which ensures that the handle portion 20 and blade portion 30 do not bend or break easily. These substantially rigid plastics are also lightweight and of low cost, and are easily mouldable into the desired shapes of the handle portion 20 and blade portion 30, respectively.

As shown specifically in FIG. 2, the one end 40 of the handle portion 20 has a slot 60 adapted to receive a portion 70 of the blade portion 30 therein. The slot 60 is cut in a substantially transverse axis with respect to the longitudinal axis of the hand tool 10 and thus extends across the transverse length of the one end 40 of the handle portion 20. As such, when the portion 70 of the blade portion 30 is received within the slot 60, the generally planar blade portion 30 is oriented in a plane substantially parallel to the longitudinal axis of the hand tool 10 (see FIGS. 1 and 3). The blade portion 30 has a transverse length that is greater than the transverse lengths of the handle portion 30 and the slot 60 such that when the portion 70 of the blade portion 30 is received within the slot 60 the two sides of the blade portion 30 extend from the two respective slides of the slot 60.

The portion 70 of the blade portion 30 may be fixedly mounted within the slot 60 of the handle portion 20 using any suitable mounting arrangement such as, for example, in this embodiment, the portion 70 of the blade portion 30 is fixedly mounted within the slot 60 of the handle portion 20 using a suitable adhesive.

In other embodiments, it will be appreciated that the portion 70 of the blade portion 30 may be removably mounted within the slot 60 of the handle portion 20 to enable the hand tool 10 to be used, for example, with one or more interchangeable blade portions 30 for removing fly-screens of different dimensions, or alternatively for replacing the blade portion 30 if it becomes damaged. In one example, the portion 70 of the blade portion 30 is removably mounted within the slot 60 of the handle portion 20 using a snap fit arrangement (not shown) in which the slot 60 comprises a first connection (not shown) in the form of a protrusion and the portion 70 of the blade portion 30 comprises a complementary second connection (not shown) in the form of a recess, such that in use, the protrusion is received within the recess to releasably lock the portion 70 of the blade portion 30 within the slot 60 to secure the blade portion 30 to the handle portion 20 of the hand tool 10. It will be appreciated that the snap fit arrangement is configured to allow the portion 70 of the blade portion 30 to also be removed from the slot 60. For example, the recess is a V-shaped recess with outwardly angled walls, and the protrusion has complementary inwardly angled walls, where the slope of the inwardly and outwardly angled walls is of a suitable angle to allow the portion 70 of the blade portion 30 to be pulled out of the slot 60. It will also be appreciated that the snap fit arrangement is not limited to comprising a single first connection and a single complementary second connection. For example, the first connection may be two or more first connections and the complementary second connection may be two or more complementary second connections.

In other embodiments, the portion 70 of the blade portion 30 may be releasably locked within the slot 60 of the handle portion 20. For example, the one end 40 of the handle portion 20 and the portion 70 of the blade portion 30 may each comprise at least one aperture (not shown) substantially therethrough, such that when the portion 70 of the blade portion 30 is inserted within the slot 60 and the apertures become substantially aligned, the substantially aligned apertures are configured for receiving a corresponding fastener (not shown) substantially therethrough to releasably lock the portion 70 of the blade portion 30 within the slot 60. In this arrangement, the one or more fasteners may include, but are not limited to, any one of the following types of fastener: a pin, a screw, a bolt, or a rivet. In one example, the pin may be a split pin or cotter pin, which once inserted through the substantially aligned apertures, the two ends or tines of the pin can be bent apart to lock the pin in place within the substantially aligned apertures, thereby releasably locking the blade portion 30 to the handle portion 20.

In another example, the apertures in the one end 40 of the handle portion 20 and the portion 70 of the blade portion 30 may have a corresponding internal screw thread configured to threadingly receive a screw fastener with a complementary external screw thread to releasably lock the blade portion 30 to the handle portion 20. In yet another example, the bolt fastener having a head and a shaft extending therefrom, is configured with at least an external screw thread at an end of the shaft distal to the head of the bolt to threadingly receive a nut or wing nut having a complementary internal screw thread to releasably lock the blade portion 30 to the handle portion 20.

As shown in FIGS. 1 to 3, the blade portion 30 defines at an end distal to the one end 40 of the handle portion 20, a hook portion 50 for insertion between the fly-screen and the window frame in use. The hook portion 50 has a length in the plane defined by the generally planar blade portion 30 (see FIGS. 1 and 3) that enables the hook portion 50 to engage a corresponding length of the edge of the fly-screen in use thereby providing more leverage for removing the fly-screen from the window frame than would be achieved using a much shorter hook portion 50. The greater contact with the edge of the fly-screen will also reduce the risk of damaging the fly-screen when applying a pulling force to remove the fly-screen from the window frame.

Referring specifically to FIG. 2, the hook portion 50 has a generally curved side profile which has a depth, width or radius that corresponds to the dimensions of the edge of the fly-screen being removed from the window frame. For example, in one embodiment, the generally curved side profile of the hook portion 50 has a depth of about 2 mm to about 30 mm, more preferably, about 5 mm to about 20 mm, still more preferably about 10 mm to about 15 mm. In another embodiment, the generally curved side profile of the hook portion 50 has a width of about 2 mm to about 30 mm, more preferably, about 5 mm to about 20 mm, still more preferably about 10 mm to about 15 mm. In yet another embodiment, the generally curved side profile of the hook portion 50 has a radius of about 1 mm to about 15 mm, more preferably, about 2.5 mm to about 10 mm, still more preferably, about 5 mm to about 7.5 mm. It will be appreciated that having a hook portion 50 with a side profile that corresponds to the dimensions of the edge of the fly-screen ensures that the hook portion 50 will engage only the edge of the fly-screen rather than the mesh of the fly-screen, thereby reducing the risk of damaging the mesh when removing the fly-screen from the window frame.

The generally curved hook portion 50 also has a substantially wedge-shaped edge 80 for aiding in easy insertion of the hook portion 50 between the edge of the fly-screen and the window frame, in which the substantially wedge-shaped edge 80 extends slightly beyond the plane of the generally planar blade portion 30. When viewed from the side, the substantially wedge-shaped edge 80 tapers from an inner face 90 of the curve of the hook portion 50 towards an outer face 100 such that the outer face 100 of the curved hook portion 50, the face that engages the window frame in use, is continuous, thereby reducing the risk of damaging the window frame when removing the fly-screen therefrom.

As shown in FIG. 2, the substantially wedge-shaped edge 80 of the hook portion 50 is generally flush with the inner face 90 of the generally planar blade portion 30 and forms at least an angle ∠A between an axis B-B' in the plane defined by the outer face 100 at the wedge-shaped edge and the longitudinal axis A-A'.

In use, the generally curved side profile of the hook portion 50 enables a user to insert the hook portion 50 between any edge of the fly-screen and window frame and to rotate the hook portion 50 around the edge of the fly-screen to enable the fly-screen to be removed from the window frame. The substantially sharpened edge 80 of the hook portion 50 is useful in situations in which the space between the edge of the fly-screen and the window frame is narrow.

To realise a more ergonomic shape, the handle portion 20 of the hand tool 10 comprises one or more indentations for receiving one or more respective fingers of a hand (not shown) therein in use. As shown in FIGS. 1 to 3, the one or more indentations are two indentations 110A, 110B, more particularly, two opposing indentations 110A, 110B located at a second end 120 farthest from the one end 40 of the handle portion 20 to enable the user to hold the hand tool 10 between the thumb and index finger. The two opposing indentations 110A, 110B define a lip at the second end 120 of the handle portion 20 which provides the user with added grip and something to pull against when applying a pulling force to remove a fly-screen from a window frame to prevent the hand tool 10 from slipping out of the user's hand in use. It will be appreciated that in other embodiments, the lip may take the form of, for example, a T-bar or a ball, to provide the user with something to pull against in removing the fly-screen from the window frame.

In other embodiments, the blade portion 30 is integral with the handle portion 20 thereby making for ease of manufacture and low cost.

In other embodiments, the second end 120 of the handle portion 20 may comprise one or more apertures (not shown) to receive a looped cord or lanyard (not shown) substantially therethrough, the looped cord being of a size to fit around the user's wrist to prevent the user from dropping the hand tool 10 in use. It will be appreciated that the looped cord may be adjustable to allow the looped cord to be tightened around the user's wrist.

The hand tool 10 for removing a fly-screen from a window frame provides a number of advantages, as described herein. It is apparent from the above, that the arrangements described are applicable in the maintenance or repair of buildings.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of example embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description of Specific Embodiments are hereby expressly incorporated into this Detailed Description of Specific Embodiments, with each claim standing on its own as a separate embodiment of this invention. Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Although the invention has been described with reference to specific examples, it will be appreciated by those skilled in the art that the invention may be embodied in many other forms.

What is claimed is:

1. A hand tool for removing a fly-screen from a window frame, comprising:

a handle portion aligned with a longitudinal axis A-A' through the tool; and a blade portion extending from one end of the handle portion, and having a hook portion at an end distal to the one end of the handle portion, said hook portion having an outer face and a concave inner tapered face ending in a wedge-shaped insertion edge at least level with the longitudinal axis A-A' and forming an angle ∠A of at least 90 degrees between an axis B-B' defined by a plane of the outer face at the insertion edge and the longitudinal axis A-A', said wedge-shaped insertion edge insertable and rotatable between the window frame and the fly-screen.

2. A hand tool as claimed in claim 1, wherein the blade portion is integral with the handle portion.

3. A hand tool as claimed in claim 1, wherein the one end of the handle portion has a slot adapted to receive a portion of the blade portion therein.

4. A hand tool as claimed in claim 1, wherein the blade portion is generally planar and oriented in a plane substantially parallel to the longitudinal axis of the hand tool.

5. A hand tool as claimed in claim 1, wherein the hook portion has a depth of about 2 mm to about 30 mm.

6. A hand tool as claimed in claim 1, wherein the hook portion has a depth of about 5 mm to about 20 mm.

7. A hand tool as claimed in claim 1, wherein the hook portion has a depth of about 10 mm to about 15 mm.

8. A hand tool as claimed in claim 1, wherein the hook portion has a width of about 2 mm to about 30 mm.

9. A hand tool as claimed in claim 1, wherein the hook portion has a width of about 5 mm to about 20 mm.

10. A hand tool as claimed in claim 1, wherein the hook portion has a width of about 10 mm to about 15 mm.

11. A hand tool as claimed in claim 1, wherein the hook portion has a radius of about 1 mm to about 15 mm.

12. A hand tool as claimed in claim 1, wherein the hook portion has a radius of about 2.5 mm to about 10 mm.

13. A hand tool as claimed in claim 1, wherein the hook portion has a radius of about 5 mm to about 7.5 mm.

14. A hand tool as claimed in claim 1, wherein the hook portion has a wedge-shaped edge for insertion between the fly-screen and the window frame.

15. A hand tool as claimed in claim 14, wherein the substantially wedge-shaped edge of the hook portion extends beyond the plane of the substantially planar blade portion.

16. A hand tool as claimed in claim 1, wherein the handle portion comprises one or more indentations for receiving one or more respective fingers of a hand therein in use.

17. A hand tool as claimed in claim 16, wherein the one or more indentations are two indentations.

18. A hand tool as claimed in claim 17, wherein the two indentations are two opposing indentations.

19. A hand tool as claimed in claim 1, wherein the blade portion is manufactured from a substantially rigid material.

20. A hand tool as claimed in claim 1, wherein the handle portion is manufactured from a substantially rigid material.

* * * * *